US010266337B2

(12) United States Patent
Farid

(10) Patent No.: US 10,266,337 B2
(45) Date of Patent: Apr. 23, 2019

(54) FRUIT ARRANGEMENT

(71) Applicant: Edible Arrangements, LLC, Wallingford, CT (US)

(72) Inventor: Tariq Farid, Chesire, CT (US)

(73) Assignee: EDIBLE IP, LLC, Wallingford, CT (US)

( * ) Notice: Subject to any disclaimer, the term of this patent is extended or adjusted under 35 U.S.C. 154(b) by 115 days.

(21) Appl. No.: 15/420,062

(22) Filed: Jan. 30, 2017

(65) Prior Publication Data

US 2017/0203912 A1 Jul. 20, 2017

Related U.S. Application Data

(62) Division of application No. 14/548,279, filed on Nov. 19, 2014, now abandoned.

(60) Provisional application No. 61/906,115, filed on Nov. 19, 2013.

(51) Int. Cl.

| | |
|---|---|
| ***B65D 25/00*** | (2006.01) |
| ***B65D 85/34*** | (2006.01) |
| ***B26D 3/26*** | (2006.01) |
| ***B26D 7/06*** | (2006.01) |
| ***A47G 19/00*** | (2006.01) |
| ***A47G 19/30*** | (2006.01) |
| ***B65D 25/04*** | (2006.01) |
| ***B65D 25/14*** | (2006.01) |

(52) U.S. Cl.

CPC ..... *B65D 85/34* (2013.01); *A47G 19/00* (2013.01); *A47G 19/30* (2013.01); *B26D 3/26* (2013.01); *B26D 7/0608* (2013.01); *B65D 25/04* (2013.01); *B65D 25/14* (2013.01)

(58) Field of Classification Search

USPC ..... 206/216, 217, 457; 220/660, 703

See application file for complete search history.

(56) References Cited

U.S. PATENT DOCUMENTS

| | | | | |
|---|---|---|---|---|
| 3,036,377 | A | 5/1962 | Paulson | |
| 3,360,161 | A * | 12/1967 | Smith | A47G 19/2272 220/719 |
| 4,938,375 | A * | 7/1990 | Fantacone | A47G 19/2211 210/464 |
| 5,337,480 | A | 8/1994 | Codikow | |
| 5,971,202 | A * | 10/1999 | Filbrun | A47G 19/2211 220/719 |
| 7,052,059 | B2 | 5/2006 | Farid et al. | |
| 7,272,950 | B1 * | 9/2007 | Roman | A47G 19/2288 62/384 |
| 7,568,414 | B2 | 8/2009 | Farid et al. | |
| D711,198 | S | 8/2014 | Cline et al. | |
| 2004/0177642 | A1 * | 9/2004 | Citrynell | A47G 19/2255 62/457.3 |
| 2004/0239131 | A1 | 12/2004 | Volk | |
| 2006/0033348 | A1 | 2/2006 | Farid et al. | |
| 2007/0228054 | A1 * | 10/2007 | Woodhouse | A47G 7/07 220/719 |

(Continued)

FOREIGN PATENT DOCUMENTS

| | | | |
|---|---|---|---|
| CH | 243555 | A | 7/1946 |
| DE | 102005048788 | A1 | 4/2007 |

(Continued)

*Primary Examiner* — Jacob K Ackun

(74) *Attorney, Agent, or Firm* — DLA Piper LLP (US)

(57) ABSTRACT

A fruit arrangement system including a cutter and a storage container.

8 Claims, 7 Drawing Sheets

(56) References Cited

U.S. PATENT DOCUMENTS

2008/0099364 A1* 5/2008 Niedzwiecki ..... A47G 19/2255 206/517
2008/0290102 A1* 11/2008 Mangano ..... A47G 19/2205 220/703
2009/0193952 A1 8/2009 Farid et al.
2010/0044385 A1* 2/2010 Williams ..... A47G 19/2205 220/703
2011/0309092 A1* 12/2011 Gatta ..... A47G 19/2211 220/703
2013/0062359 A1* 3/2013 Stern ..... A47G 19/2205 220/745
2013/0075356 A1* 3/2013 Bergida ..... A47G 19/2205 215/329
2013/0233870 A1* 9/2013 Miller ..... A47G 19/22 220/719
2014/0030400 A1 1/2014 Farid et al.
2014/0117029 A1* 5/2014 Harvey ..... A47G 19/2288 220/660
2014/0299601 A1* 10/2014 Schiavone ..... A47G 19/2205 220/288
2015/0289692 A1* 10/2015 Bell ..... A47G 19/2288 220/592.17
2016/0031107 A1 2/2016 Farid
2016/0278555 A1* 9/2016 Taormina ..... A47G 19/23
2017/0280899 A1 10/2017 Mockler et al.

FOREIGN PATENT DOCUMENTS

DE 102007042660 A1 3/2009
JP 2010-148840 A 7/2010
JP 2012-228499 A 11/2012
KR 10-0647478 B1 11/2006
WO 20171173418 A1 10/2017

* cited by examiner

FRUIT ARRANGEMENT

PRIORITY

This application is a divisional of U.S. patent application Ser. No. 14/548,279, filed on Nov. 19, 2014 and entitled "FRUIT ARRANGEMENT," which in turn claims priority to provisional filing 61/906,115 filed Nov. 19, 2013, each of which is hereby incorporated by reference in its entirety.

FIELD OF INVENTION

The invention is directed to unique ways in preparing fruit arrangements and presenting them to consumers in a commercial environment. The inventions incorporate unique designs and features of multiple items of which each one singularly represents an innovative concept and design.

BACKGROUND OF THE INVENTION

Selling items to the consuming public requires "catchy" items which attract the attention of the consumer. This is a common occurrence in just about every commodity sold which does not include technology. In the fruit arrangement business, creativity is necessary to attract customers and ultimate purchasers. This invention identifies several discrete components, each individually patentable on their own for the creation, display and sale of fruit arrangements.

DRAWINGS

This disclosure includes several drawings depicting various elements.

SUMMARY

A fruit arrangement carrier comprising a central body having a conical shape resembling a martini glass. A wide base for carrying said central body. The central body having an internal lip creating an offset with the interior of the central body. A weighted cover having a downwardly extending lip for being received with said offset for securing said weighted cover with said central body.

Preferred Embodiment

The assignee of these inventions, Edible Arrangements, International has received several patents on the development of systems, methods, designs, relating to the processing and selling of unique fruit arrangements. Such patents include designs for the various shapes of the cut fruit, machines utilized for cutting the fruit, and individual components of the assemblies such as the foam.

Figure 1A:
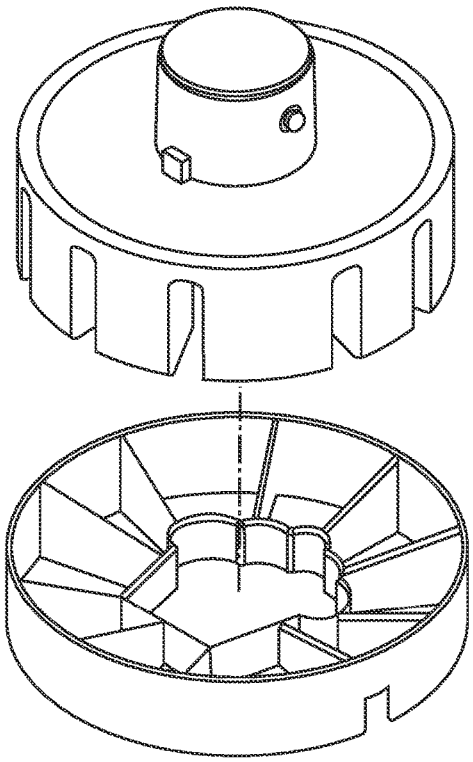
FIGS. 1A to 1D illustrate a cupcake press cutter.
Figure 1B:
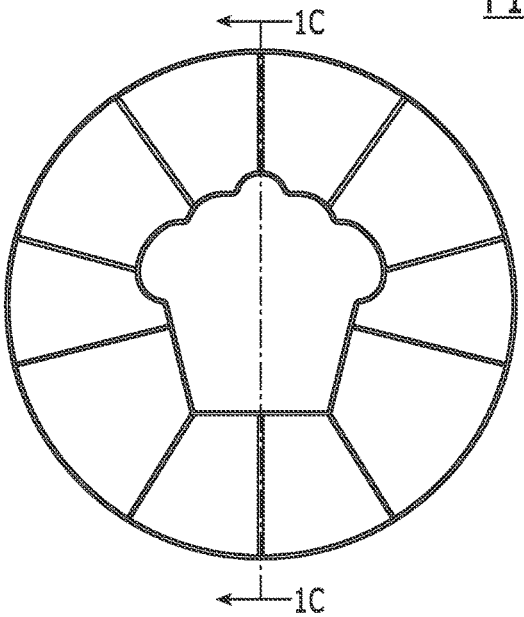
Figure 1C:
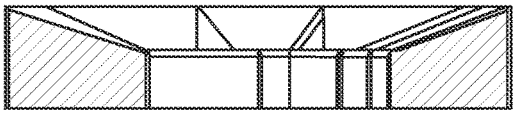
Figure 1D:
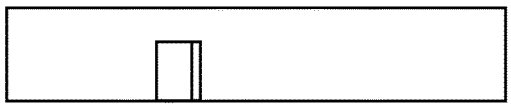
Figure 2A:
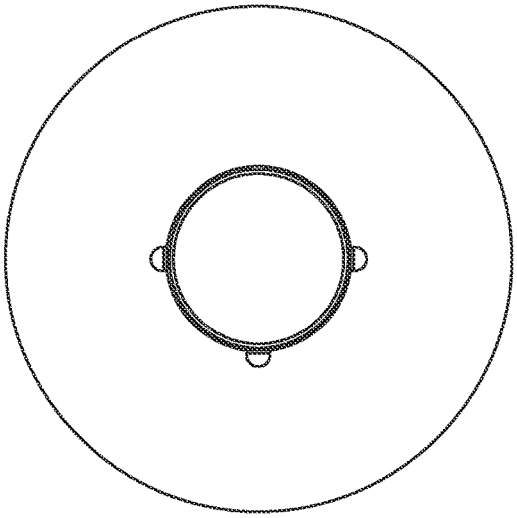
FIGS. 2A to 2E illustrate a cupcake press for operation with the cupcake press cutter for developing a cupcake design.
Figure 2B:
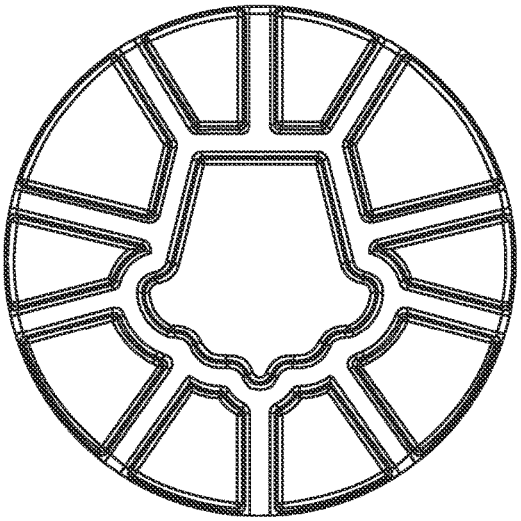
Figure 2C:
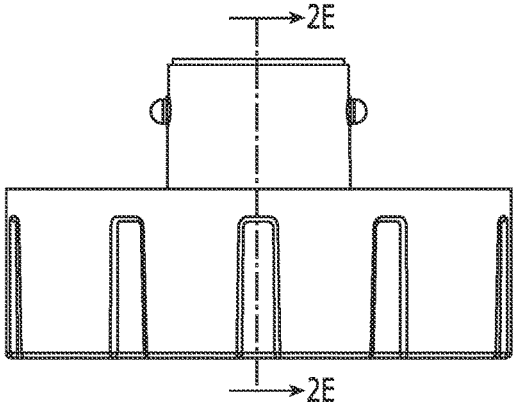
Figure 2D:
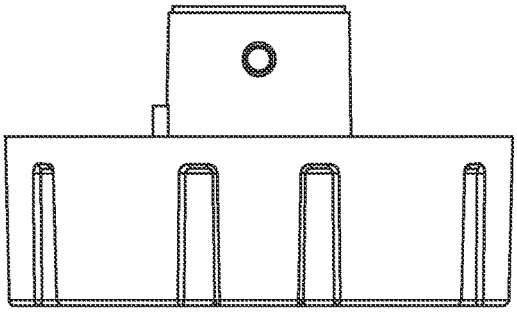
Figure 2E:
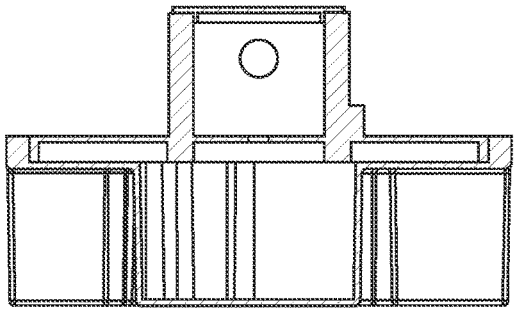

The cupcake press cutter is intended for use in the melon wedger U.S. Pat. No. 7,568,414 and its derived modifications. The cupcake cutter includes location notches, is made from food safe stainless steel and has a central cupcake design with tangential blade components. In the preferred embodiment a pineapple is utilized as the fruit of choice for the cupcake design. A related press which pushes the fruit through the blade is illustrated in FIGS. 2A-2E.

The press cutter has a central design supported by internally extending ribs which extend from an outer circular frame. The central design is suspended by the internally extending ribs enabling the design to be placed onto a piece of fruit, preferably a pineapple. An external notch defined with the external frame enables the cutter to be positioned in a select position enabling a corresponding press cutter to be aligned. The corresponding press cutter has a plurality of fingers extending downward from an upper body. The plurality of fingers extends downward for interfacing with corresponding orifices of the press cutter. In the preferred embodiment, a cupcake designs centrally located for passing through the central design of the cupcake press cutter.

Figure 3A:
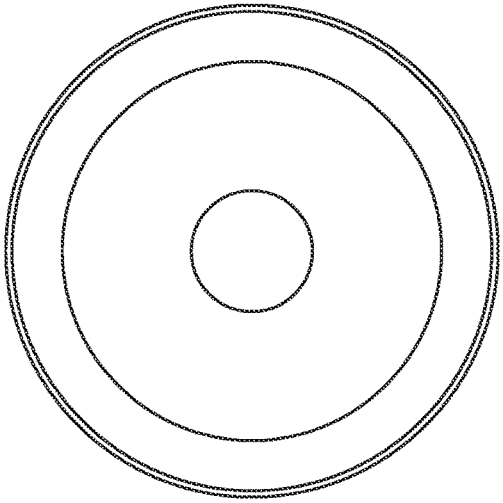
FIGS. 3A to 3H illustrate a martini cup assembly for holding a fruit arrangement.
Figure 3B:
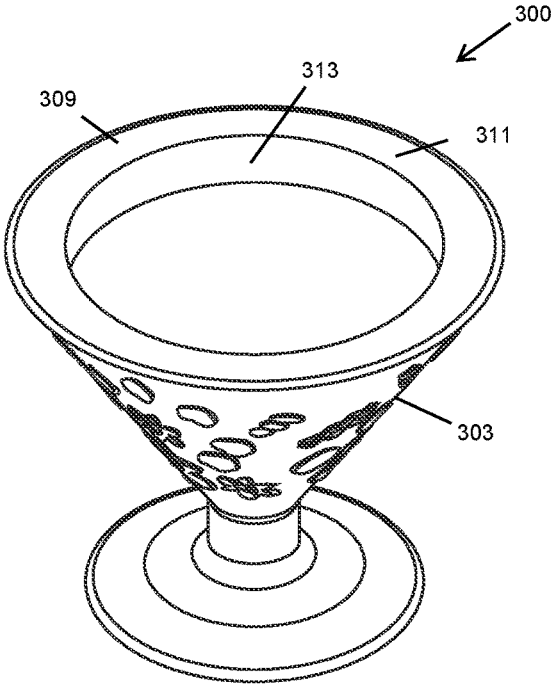
Figure 3C:
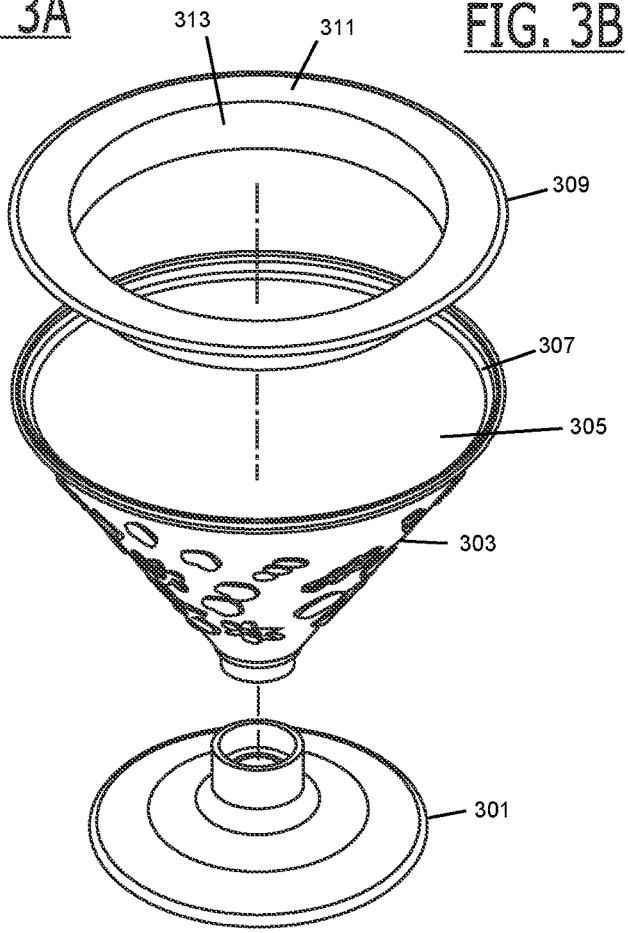
Figure 3D:
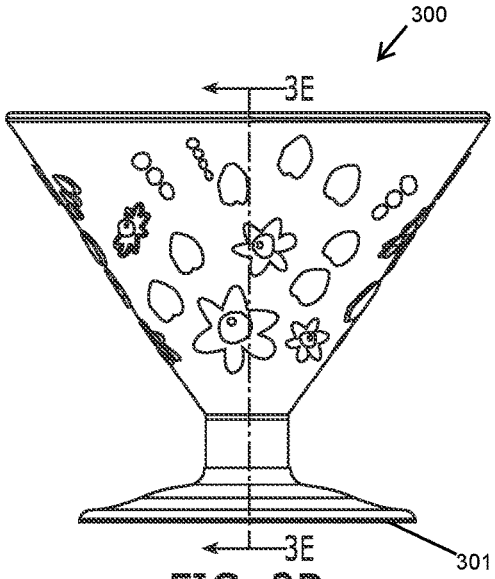
Figure 3E:
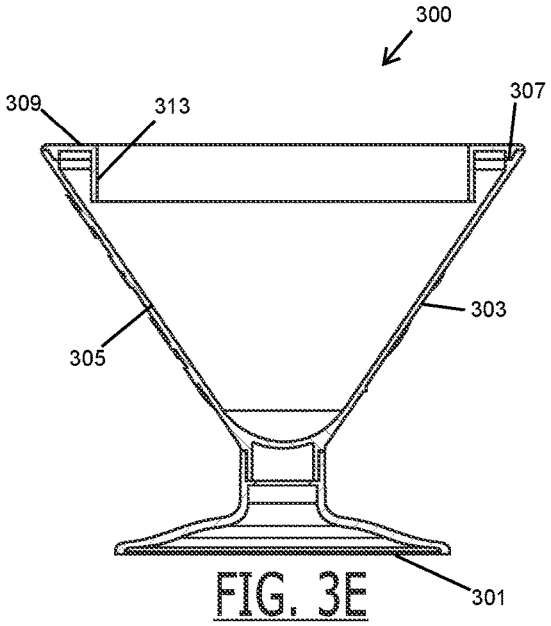
Figure 3F:
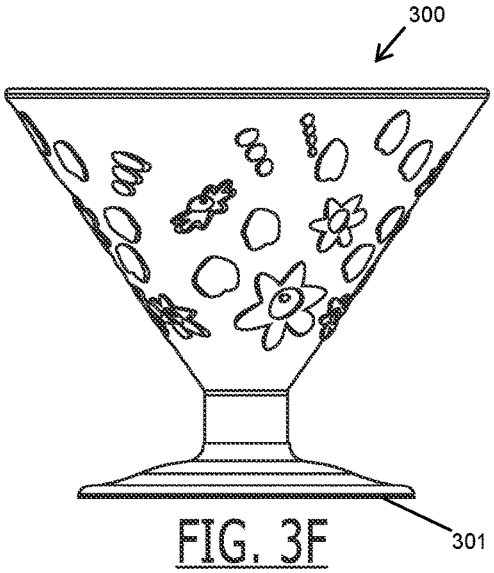
Figure 3G:
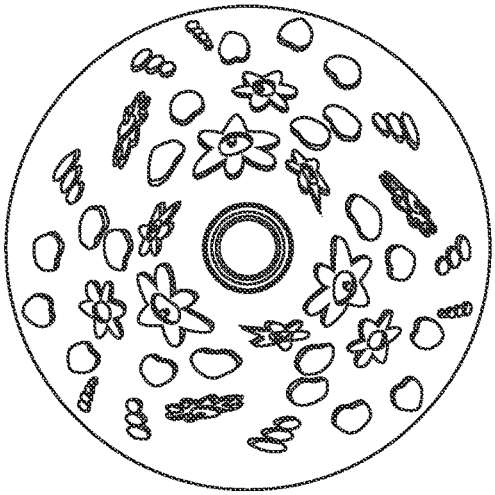
Figure 3H:
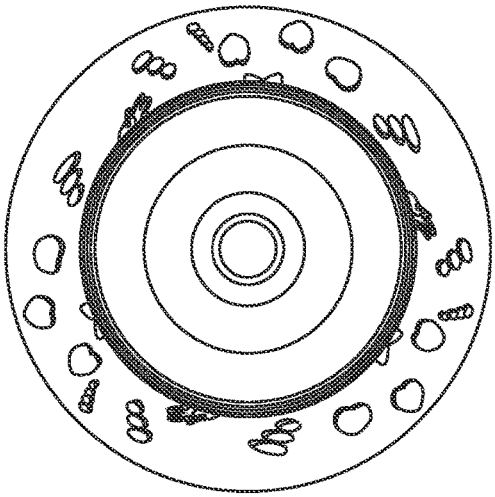

As shown in FIGS. 3A through 3H a martini glass fruit holder 300 is disclosed. The martini glass 300 includes a circular base 301 for balance, a central conical body 303 shaped like a martini glass. As shown in the figures, the central conical body 303 has an interior 305 which has a sloped surface. An upper lip 307 is formed within the interior 305 of the central conical body 303. The upper lip 307 is vertically positioned establishing an offset from the interior.

Figure 4A:
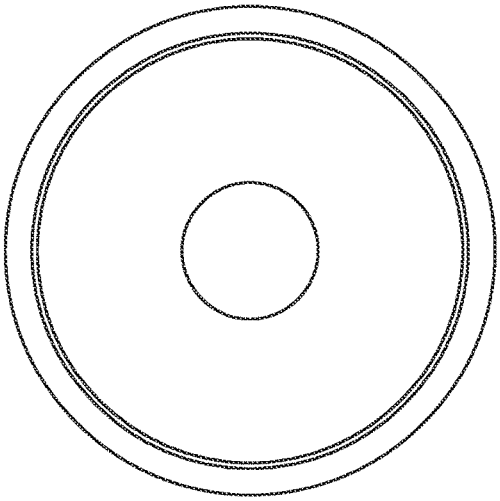
FIGS. 4A to 4E illustrate a second embodiment of a martini cup assembly for holding a fruit arrangement.
Figure 4B:
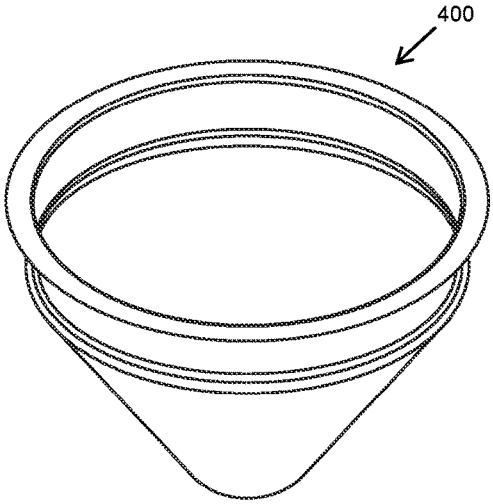
Figure 4C:
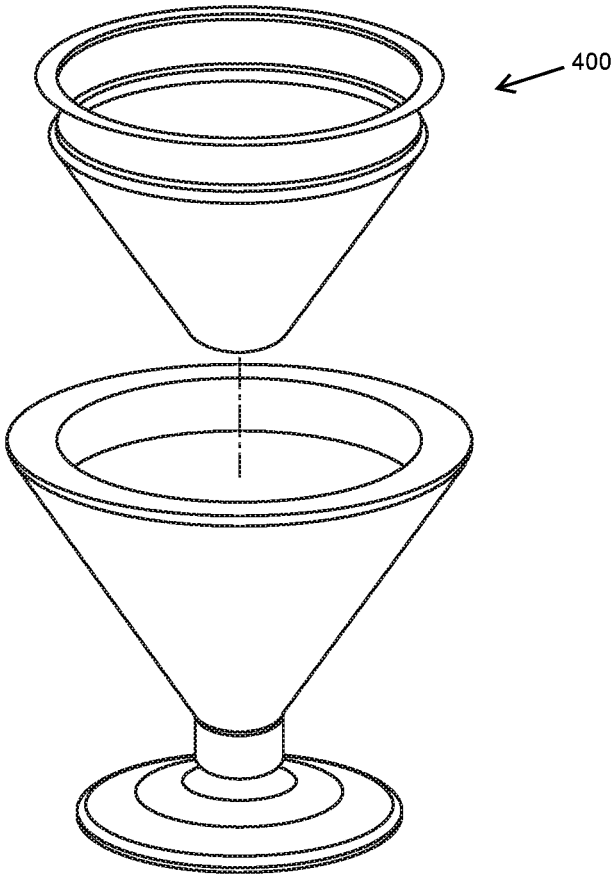
Figure 4D:
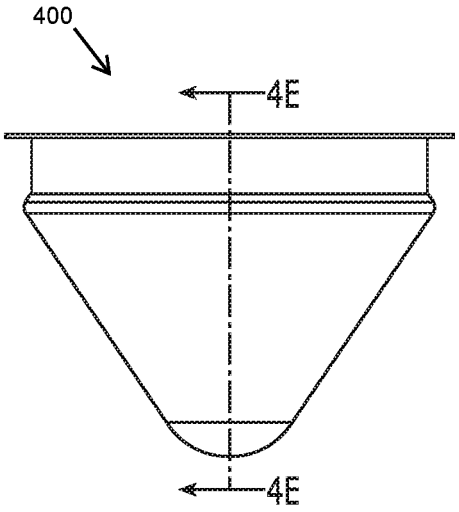
Figure 4E:
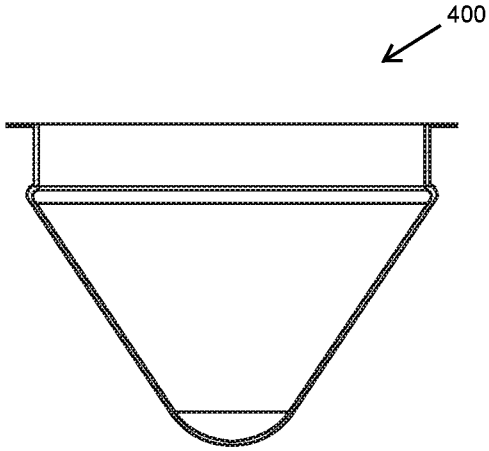

A weighted cover 309 is included for providing balance for the arrangement. The weighted cover 309 includes an upper rim 311 and a downwardly extending central portion 313. A downwardly extending portion 313 extends downward from the outer perimeter of the upper rim 311. As shown in the drawings (FIGS. 4A through 4E), this downwardly extending portion 313 is received within the offset of the central conical body 303 for securing the upper weighted cover 309 with the central conical body 303. The weight of the cover 309 is sufficient to retain the central conical body 303 in an upright position when an assembly of fruit is positioned within the central conical body 303.

A wide base 301 to balance the high center of gravity which results from assembling a fruit arrangement with in the barrel of the container. A central cup portion 303 having a conical appearance. A lip 307 is disposed within the interior circumference of the upper portion of the cup. The lip 307 assists in retaining the foam which is utilized for supporting the fruit arrangement; the foam is disclosed in U.S. Pat. No. 8,474,616, within the structure. An upper cap is received within the barrel of the container and rests on the upper rim of the upper Lip. The upper cap also assists in retaining the foam within the structure. Various drawings are disclosed illustrating this design. Additionally, a central liner 400 may be utilized for retaining the fruit assembly within the interior of the "glass".

A packaging sleeve is presented which has a unite design and which may be utilized for encircling the base of the martini glass. The packaging sleeve is trifold having an upper arched shape with three container tabs located at the base of the sleeve which the bottom of the martini container will rest upon. The packaging sleeve assists in the portability of the martini glass as the glass may tip over during delivery from a franchise location to a customer. This sleeve assists in maintaining the martini glass upright.

Figure 5A:
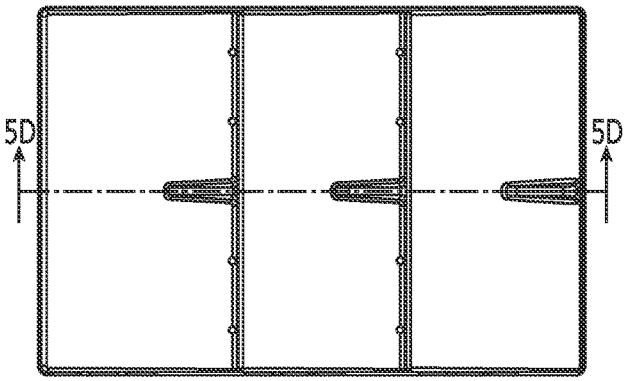
FIGS. 5A to 5E illustrate a pine pop tray for holding cut pineapples.
Figure 5B:
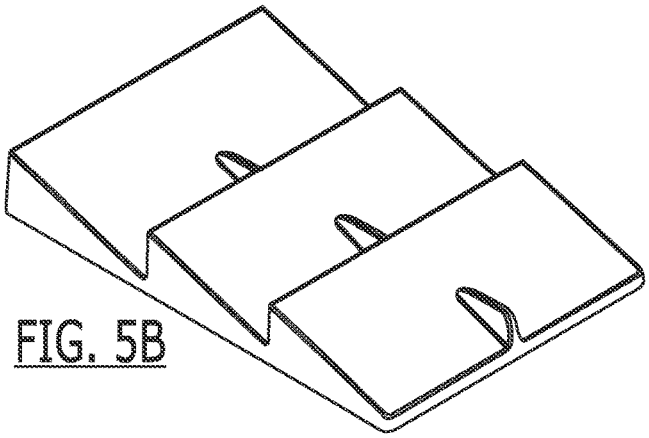
Figure 5C:
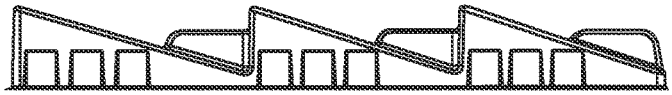
Figure 5D:
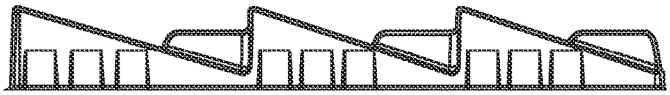
Figure 5E:
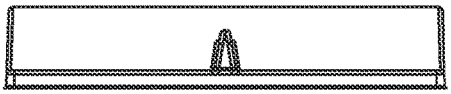

Additionally a pine pop tray is disclosed which is designed for holding a plurality of pineapple pieces (FIGS. 5A through 5E). The pine pop tray includes a central flange divider enabling separation of the respective pineapple pieces. The pine pop tray includes a front surface and a back surface offset forming a storage chamber for receiving a pineapple piece. A plurality of holes is positioned within the base of the storage chambers enabling any fluids to flow downward to a lower located storage chamber. As shown in the drawings, one embodiment includes three distance levels of adjacent storage chambers.

A pineapple pop tray is also disclosed. This tray may be used for onsite presentation of various fruit pieces singularly displayed on skewers. Once such item is the popular cupcake design which is currently the subject of several copending patent applications. The pop tray includes individual compartments for receiving a skewered fruit which includes a central divider for separating the fruit along the length of the fruit. Accordingly the divider is centrally located. The pop tray may be nested with additional trays with the lower central divider of a particular pop tray facilitating in maintaining the separation of the respective displayed fruit carried by a separate pop tray. Each respective compartment includes drain holes for facilitating in the operation of the tray.

I claim:

1. A fruit arrangement carrier, comprising:

a central body having a conical shape, wherein the central body has an upper lip creating an offset with an interior of the central body;

a wide base for carrying said central body, wherein the wide base is joined with the bottom of the central body by a stem; and a weighted cover having an upper rim and a downwardly extending portion, wherein the upper rim has an opening providing access to the interior of the central body, wherein the downwardly extending portion is attached to an inside edge of the upper rim, and wherein an outer edge of the upper rim is received by said offset for securing said weighted cover with said central body.

2. The fruit arrangement carrier of claim 1, wherein the upper rim has a ring-like flat surface.

3. The fruit arrangement carrier of claim 1, further comprising a liner insert, wherein the liner insert comprises:

a lower portion having a conical shape, wherein the lower portion fits within the central body of the fruit arrangement carrier.

4. The fruit arrangement carrier of claim 3, wherein the liner insert further comprises:

an upper portion connected to the top opening of the lower portion, wherein the upper portion comprises a upwardly extending lip compatibly received by the downwardly extending portion of the fruit arrangement carrier.

5. The fruit arrangement carrier of claim 4, wherein the liner insert further comprises:

a second top surface having an opening providing access to the inside of the lower portion, wherein the upwardly extending lip is joined with the inside edge of the second top surface.

6. The fruit arrangement carrier of claim 4, wherein the lower portion of the linear insert and the central body of the fruit arrangement carrier are concentric conical shapes.

7. The fruit arrangement carrier of claim 5, wherein the second top surface structure has a ring-like flat surface.

8. The fruit arrangement carrier of claim 1, wherein the central body comprises a bottom enclosure.

* * * * *